US005255736A

United States Patent [19]

Kotlyar

[11] Patent Number: 5,255,736

[45] Date of Patent: Oct. 26, 1993

[54] AIR FLOW ENHANCING STACK

[75] Inventor: Michael Kotlyar, Rancho Palos Verdes, Calif.

[73] Assignee: Atlantic Richfield Company, Los Angeles, Calif.

[21] Appl. No.: 992,665

[22] Filed: Dec. 18, 1992

[51] Int. Cl.[5] ..... F24H 9/02

[52] U.S. Cl. ..... 165/128; 165/903; 392/347

[58] Field of Search ..... 165/128, 903, 129; 392/347, 352

[56] References Cited

U.S. PATENT DOCUMENTS

| | | | |
|---|---|---|---|
| 501,901 | 7/1893 | Smith | 165/128 |
| 1,052,997 | 2/1913 | Barstow | 392/347 |
| 2,096,285 | 10/1937 | Lord et al. | 165/128 X |
| 2,501,812 | 3/1950 | Fodor | 126/67 |
| 3,275,495 | 9/1966 | Lang | 165/47 |
| 3,448,792 | 6/1969 | Lawrence | 165/1 |
| 3,828,566 | 8/1974 | Wetzel | 62/143 |

FOREIGN PATENT DOCUMENTS

| | | | |
|---|---|---|---|
| 2805164 | 8/1979 | Fed. Rep. of Germany | 165/128 |
| 176222 | 8/1961 | Sweden | 392/347 |
| 1663366 | 7/1991 | U.S.S.R. | 165/903 |

*Primary Examiner*—Allen J. Flanigan
*Attorney, Agent, or Firm*—Albert C. Metrailer

[57] ABSTRACT

An improved air flow enhancing stack for use with an air cooled heat exchanger designed for natural convection cooling. The stack includes a lower conical section having a larger end attached to the natural convection air exhaust from the heat exchanger and a smaller end positioned above the larger end. A central cylindrical section having a diameter equal to the diameter of the smaller end of the lower conical section is attached to the upper end of the lower conical section. An upper conical section, having a smaller end of diameter equal to the cylindrical section, is attached to the upper end of the cylindrical section and has its larger end positioned above its smaller end. A complete air enhancing stack provides improved convection cooling as compared to a conventional straight exhaust stack.

3 Claims, 1 Drawing Sheet

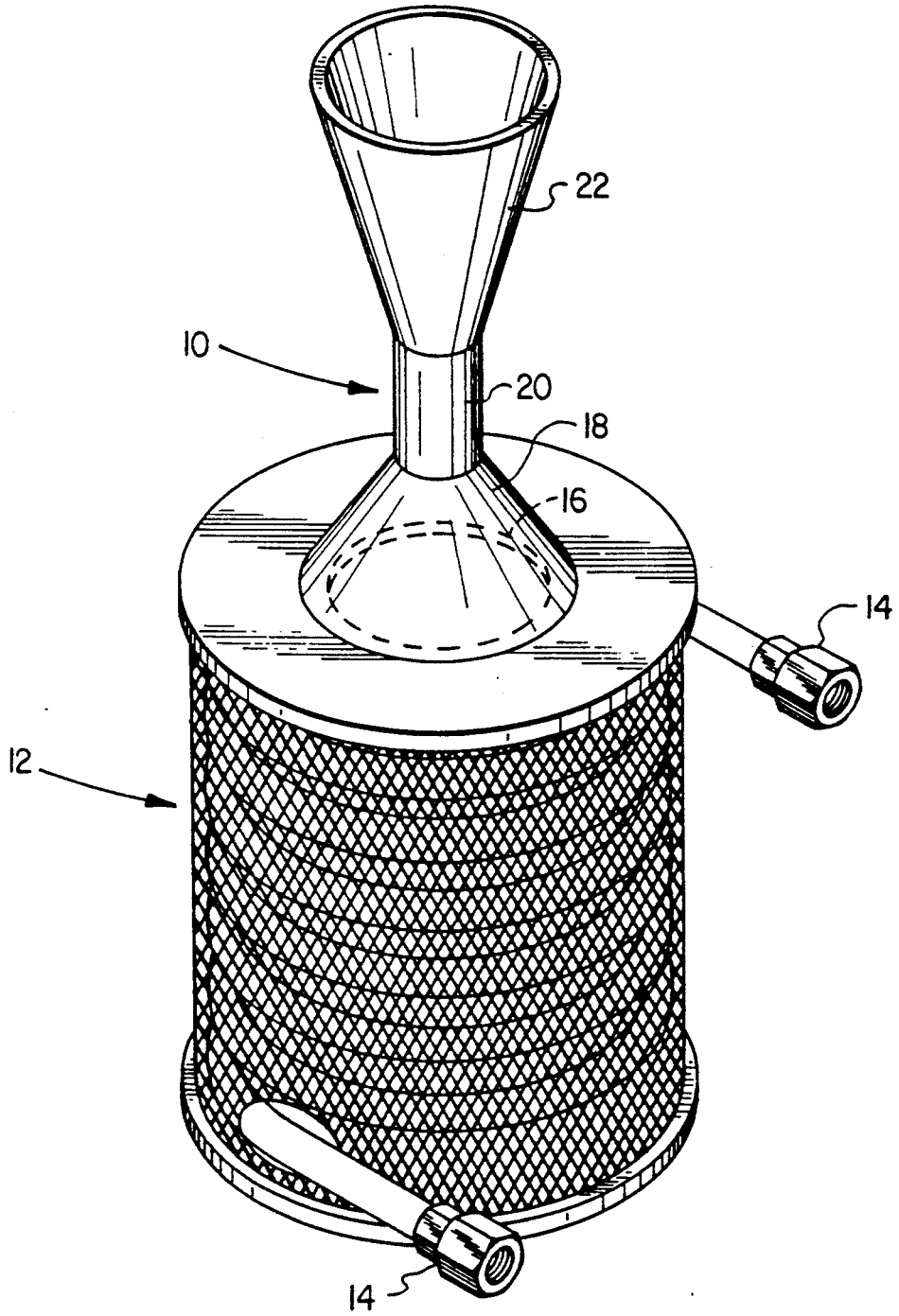
22
10
20
18
16
14
12
14

AIR FLOW ENHANCING STACK

BACKGROUND OF THE INVENTION

This invention relates to an improved convection air cooled heat exchanger, and more particularly to an air flow enhancing stack which improves the cooling properties of such heat exchanger.

Modern manufacturing and processing plants employ numerous heat exchangers for cooling hot fluids. A typical heat exchanger is sold by the Durametallic Corporation of Kalamazoo, Mich. under the designation model 625 and comprises a coiled stainless steel tubing fitted with air cooling fins to enhance heat transfer to ambient air. In this type of cooler, the tubing is coiled into a generally hollow cylinder shape, with a hot air exhaust opening at the top, which is positioned vertically to allow cooling by the natural convection currents flowing upwards through the cylinder. Cooling efficiency can be greatly enhanced by installation of an available electric motor driven fan to force ambient air through the coiled tubing.

However, due the numerous regulations which apply to modern processing plants, installation of additional electrically powered equipment, such as the cooling fan, often requires obtaining additional permits. Such a forced cooling fan also consumes additional power, thereby increasing the cost of operating the plant. Thus, in many situations, it would be desirable to use the heat exchanger without any type of forced cooling apparatus. In such situations it is often desirable to improve the cooling characteristic of the heat exchanger by adding some passive means of improving convection currents.

An obvious addition to such a heat exchanger is a traditional straight pipe or chimney fitted to the upper air exhaust. However, in many cases the space available above the heat exchanger does not provide a sufficiently tall convection stack to provide the desired level of air cooling.

SUMMARY OF THE INVENTION

According to the present invention, the efficiency of a natural convection heat exchanger can be enhanced by use of an improved stack comprising upper and lower hollow conical sections connected by a central hollow cylindrical section. The smaller ends of each conical section are connected to the ends of the cylindrical section. The larger end of the lower conical section is sized to fit the exhaust from a conventional convection cooled heat exchanger.

DESCRIPTION OF THE DRAWING

The single figure is a perspective view of an improved air flow enhancing stack mounted to the top of a conventional natural convection heat exchanger.

DESCRIPTION OF THE PREFERRED EMBODIMENTS

With reference to the figure, there is illustrated an improved air flow enhancing stack 10 connected to the air exhaust of a conventional air cooled heat exchanger 12. Heat exchanger 12 in the preferred embodiment is a model 625 n.c. sold by Durametallic Corporation of Kalamazoo, Mich. This heat exchanger has a nominal outer diameter of 11.75 inches and a height of 11.75 inches. Its primary heat exchanger element is coiled stainless steel tubing 14 which is finned and formed into a hollow cylinder to provide an air flow passage through the middle of the heat exchanger. The outer surface of the heat exchanger 12 is provided with a protective metal grill through which air may easily flow. As provided by the manufacturer, natural convection current flowing through an exhaust opening on the upper end of heat exchanger 12 draws ambient air through the protective grill and the heat exchanging fins to cool fluid passing through tubing 14.

In the preferred embodiment, the air flow enhancing stack 10 is provided to increase the amount of air flowing through heat exchanger 12. The stack 10 comprises a lower conical section 18 having a larger end approximately the same diameter or slightly larger than the exhaust opening 16 of heat exchanger 12. This larger end is bolted or otherwise attached to the upper end of heat exchanger 12. The upper and smaller end of conical section 18 is connected to a cylinder section 20 having a diameter equal to the diameter of the smaller end of conical section 18. The stack 10 also includes an upper conical section 22 having a smaller end of diameter equal to the diameter of cylinder section 20 and attached to the upper end of section 20. The larger end of section 22 forms the top of the completed stack. In the preferred embodiment, all of the sections of stack 10 were formed from 12 gauge aluminum sheet material and were welded together. The cylindrical section 20 was two inches in diameter and had a length of three inches. The larger end of conical section 18 had a diameter of six and one half inches and the larger end of conical section 22 had a diameter of six inches. The lower conical section 18 had a vertical height of three inches and upper conical section 22 had a height of six inches, for an overall stack height of twelve inches.

Our tests indicated that this improved air flow enhancing stack improves air flow in a manner equivalent to a straight cylindrical stack having a height of approximately three times as great. The temperature difference between the bottom and top of a stack will induce a draft. The flow inducement phenomenon is a function of draft and frictional resistance. The advantage of this air flow enhancing stack is that it permits a reduction of the frictional resistance by means of converging and diverging geometry versus a straight cylindrical section. Thus, the improved stack allows use of a convection cooler in spaces which previously would have required a forced air cooler.

The heat exchanger 12 as provided by the manufacturer is open both at its bottom and top surfaces. When using the air flow enhancing stack 10, it is preferred to close, at least partially, the bottom opening of the heat exchanger to force air to pass through the protective grill and cooling fins. This can be done by either mounting the heat exchanger 10 on a solid surface or providing a damper plate attached to the bottom of heat exchanger 12. In the preferred embodiment, a damper plate was manufactured from 12 gauge aluminum and attached to the bottom of heat exchanger 12. In this embodiment, a three inch diameter hole was provided in the middle of the damper plate to allow limited ambient air flow.

While the present invention has been illustrated and described with reference to particular apparatus and methods of use, it is apparent that various modifications can be made therein within the scope of the invention as defined by the appended claims.

What is claimed is:

1. In an air cooled heat exchanger of the type comprising heat exchanging tubing positioned about an air passage having an air exhaust opening at its top to allow air flow by convection, the improvement comprising:

an air flow enhancing stack having a lower conical section a larger end at least as large in diameter as the air exhaust opening of said heat exchanger attached to said opening, and positioned with its smaller end above its larger end;

a central cylindrical section having a diameter equal to the smaller end of said lower conical section, one end of said cylindrical section connected to the smaller end of said lower section;

an upper conical section having a smaller end having a diameter equal to the diameter of said central section, said smaller end connected to the upper end of said central section, and having its larger end positioned above its smaller end.

2. An air flow enhancing stack according to claim 1, wherein the central section has a length about equal to its diameter.

3. An air flow according to claim 1 wherein, the heat exchanging tubing is formed in a coil about the air passage.

* * * * *